US008824911B2

(12) United States Patent
Suzuki et al.

(10) Patent No.: US 8,824,911 B2
(45) Date of Patent: Sep. 2, 2014

(54) FIXING DEVICE AND IMAGE FORMING APPARATUS

(75) Inventors: Shuichi Suzuki, Kanagawa (JP); Tsuyoshi Sunohara, Kanagawa (JP); Hajime Kishimoto, Kanagawa (JP); Motofumi Baba, Kanagawa (JP); Shinichi Kinoshita, Kanagawa (JP); Takeo Iwasaki, Kanagawa (JP); Takashi Ito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 56 days.

(21) Appl. No.: 13/571,612

(22) Filed: Aug. 10, 2012

(65) Prior Publication Data

US 2013/0195491 A1 Aug. 1, 2013

(30) Foreign Application Priority Data

Jan. 26, 2012 (JP) ..... 2012-014034

(51) Int. Cl.
*G03G 15/20* (2006.01)

(52) U.S. Cl.
CPC ..... *G03G 15/2078* (2013.01); *G03G 15/2003* (2013.01)
USPC ..... 399/69; 399/67; 399/68

(58) Field of Classification Search
CPC ..... G03G 15/20; G03G 21/00
USPC ..... 399/67–89
See application file for complete search history.

(56) References Cited

U.S. PATENT DOCUMENTS 6,021,303 A * 2/2000 Terada et al. ..... 399/328
7,368,687 B2 * 5/2008 Kagawa ..... 219/619
7,437,112 B2 * 10/2008 Yamaji ..... 399/328
7,620,338 B2 * 11/2009 Yamada et al. ..... 399/70
7,623,818 B2 * 11/2009 Ohhara et al. ..... 399/329
7,801,457 B2 * 9/2010 Seo et al. ..... 399/69
7,907,870 B2 * 3/2011 Haseba et al. ..... 399/122
7,965,970 B2 * 6/2011 Haseba et al. ..... 399/329
8,078,073 B2 * 12/2011 Kinouchi et al. ..... 399/69
8,145,113 B2 * 3/2012 Murakami et al. ..... 399/329
8,478,180 B2 * 7/2013 Arimoto et al. ..... 399/329
8,498,562 B2 * 7/2013 Yonekawa ..... 399/329
8,521,074 B2 * 8/2013 Murakami et al. ..... 399/329
2002/0116144 A1 * 8/2002 Yamauchi et al. ..... 702/132
2005/0281595 A1 * 12/2005 Kachi ..... 399/329
2006/0029444 A1 * 2/2006 Naito et al. ..... 399/329
2006/0088329 A1 * 4/2006 Suzuki et al. ..... 399/69

(Continued)

FOREIGN PATENT DOCUMENTS

JP 2003-307964 A 10/2003

*Primary Examiner* — Clayton E Laballe
*Assistant Examiner* — Kevin Butler
(74) *Attorney, Agent, or Firm* — Sughrue Mion, PLLC

(57) ABSTRACT

A fixing device includes a fixing member including a heat generating layer that generates heat by induction, the fixing member fixing images onto plural recording media that are successively supplied thereto with heat generated from the heat generating layer; a pressure member that contacts the fixing member and forms a nip between the pressure member and the fixing member, the nip allowing the recording media to pass therethrough; an induction heating unit that inductively heats the heat generating layer of the fixing member; and a controller that controls a manner in which the induction heating unit heats the heat generating layer when the plural recording media successively pass through the nip in accordance with a total of times during which the recording media are not present in the nip, the total of times being measured from when the recording media started passing through the nip.

8 Claims, 8 Drawing Sheets

(56) References Cited

U.S. PATENT DOCUMENTS

| | | | | |
|---|---|---|---|---|
| 2007/0047991 | A1* | 3/2007 | Itoh et al. | 399/69 |
| 2007/0110466 | A1* | 5/2007 | Yamaji | 399/69 |
| 2007/0242990 | A1* | 10/2007 | Ohhara et al. | 399/329 |
| 2008/0253789 | A1* | 10/2008 | Yoshinaga et al. | 399/69 |
| 2009/0028617 | A1* | 1/2009 | Katakabe et al. | 399/333 |
| 2009/0060550 | A1* | 3/2009 | Seo | 399/69 |
| 2009/0103958 | A1* | 4/2009 | Takai et al. | 399/330 |
| 2009/0175644 | A1* | 7/2009 | Nanjo et al. | 399/69 |
| 2009/0232534 | A1* | 9/2009 | Haseba et al. | 399/69 |
| 2009/0317158 | A1* | 12/2009 | Murakami et al. | 399/333 |
| 2010/0054786 | A1* | 3/2010 | Hara | 399/69 |
| 2010/0215390 | A1* | 8/2010 | Tomita et al. | 399/69 |
| 2010/0247183 | A1* | 9/2010 | Haseba et al. | 399/329 |
| 2010/0247184 | A1* | 9/2010 | Iwai | 399/329 |
| 2010/0247185 | A1* | 9/2010 | Baba et al. | 399/329 |
| 2011/0194881 | A1* | 8/2011 | Yonekawa | 399/329 |
| 2012/0107003 | A1* | 5/2012 | Hasegawa | 399/69 |
| 2012/0148319 | A1* | 6/2012 | Murakami et al. | 399/329 |
| 2012/0207502 | A1* | 8/2012 | Seo | 399/69 |
| 2013/0058673 | A1* | 3/2013 | Kikkawa | 399/69 |
| 2013/0195491 | A1* | 8/2013 | Suzuki et al. | 399/69 |
| 2013/0209123 | A1* | 8/2013 | Waida et al. | 399/68 |
| 2013/0209126 | A1* | 8/2013 | Seo et al. | 399/69 |

* cited by examiner

FIXING DEVICE AND IMAGE FORMING APPARATUS

CROSS-REFERENCE TO RELATED APPLICATIONS

This application is based on and claims priority under 35 USC 119 from Japanese Patent Application No. 2012-014034 filed Jan. 26, 2012.

BACKGROUND (i) Technical Field

The present invention relates to a fixing device and an image forming apparatus.

(ii) Related Art

Various technologies have been proposed in order to reduce power consumption of a fixing device of an image forming apparatus.

SUMMARY

According to an aspect of the invention, a fixing device includes a fixing member including a heat generating layer that generates heat by induction, the fixing member fixing images onto plural recording media that are successively supplied thereto with heat generated from the heat generating layer; a pressure member that contacts the fixing member and forms a nip between the pressure member and the fixing member, the nip allowing the recording media to pass therethrough; an induction heating unit that inductively heats the heat generating layer of the fixing member; and a controller that controls a manner in which the induction heating unit heats the heat generating layer when the plural recording media successively pass through the nip in accordance with a total of times during which the recording media are not present in the nip, the total of times being measured from when the recording media started passing through the nip.

BRIEF DESCRIPTION OF THE DRAWINGS

An exemplary embodiment of the present invention will be described in detail based on the following figures, wherein.

DETAILED DESCRIPTION

Exemplary Embodiment

Overall Structure of Image Forming Apparatus

Hereinafter, an exemplary embodiment of the present invention will be described with reference to the drawings.

Figure 1:
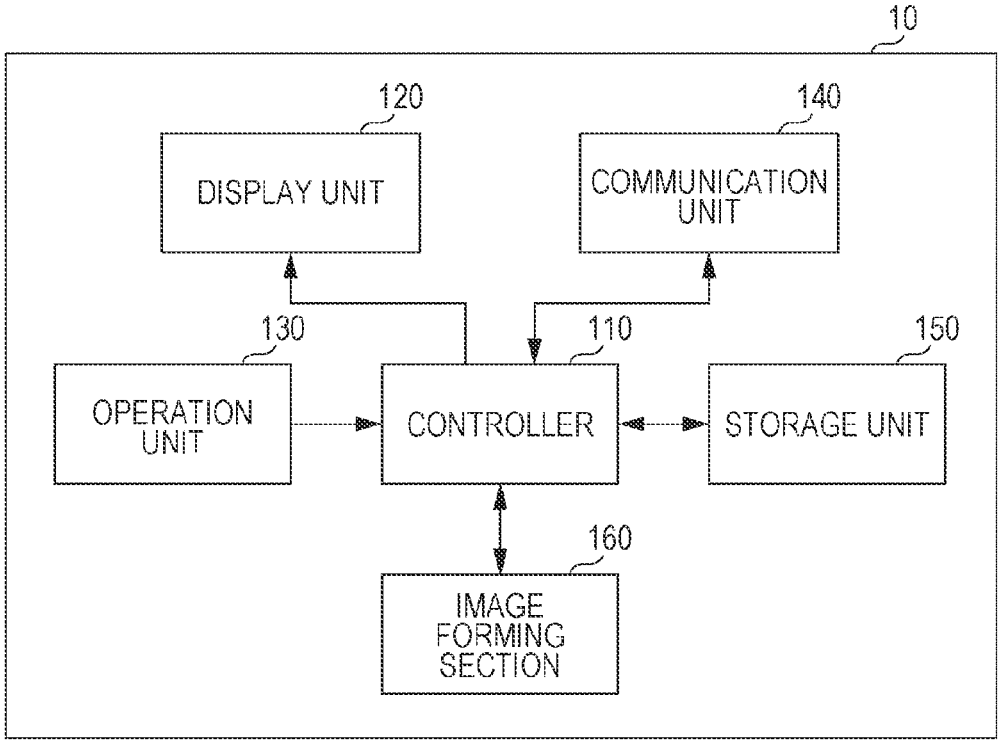
FIG. 1 is a block diagram of an image forming apparatus according to the exemplary embodiment of the present invention.

FIG. 1 is a block diagram of an image forming apparatus 10 according to the exemplary embodiment of the present invention. The image forming apparatus 10 forms an image in accordance with image data. The image forming apparatus 10 includes a controller 110, a display unit 120, an operation unit 130, a communication unit 140, a memory 150, and an image forming section 160. The controller 110 is a computer including a calculation device, such as a central processing unit (CPU), and a memory. The processor of the controller 110 controls various units included in the image forming apparatus 10 and processes data by executing a program stored in the memory. The controller 110 has a function of measuring time and obtains the time at which such control or processing is performed or performs such control or processing at a predetermined time. The controller 110 is an example of a controller according to the present invention.

The display unit 120 includes a liquid crystal display and a liquid crystal display driving circuit. The display unit 120 displays the status of processing and information instructing on an operation of the apparatus for a user on the basis of information supplied from the controller 110. The operation unit 130 includes an operation device such as buttons and supplies information regarding a user's operation to the controller 110. The communication unit 140 is connected to a communication network such as a local area network (LAN) and performs communication with an external apparatus connected to the communication network. From the external apparatus, for example, image data for forming an image and request data representing request to form the image on a recording medium (such as a sheet) are transmitted. The communication unit 140 supplies the transmitted data to the controller 110. The memory 150 includes a storage device such as a hard disk drive (HDD) and stores, for example, the image data. The image forming section 160 forms an image on a sheet using four-color toners in yellow (Y), magenta (M), cyan (C), and black (K) by using an electrophotographic method. The recording medium may be made of paper or another material such as a plastic.

Structure of Image Forming Unit

Figure 2:
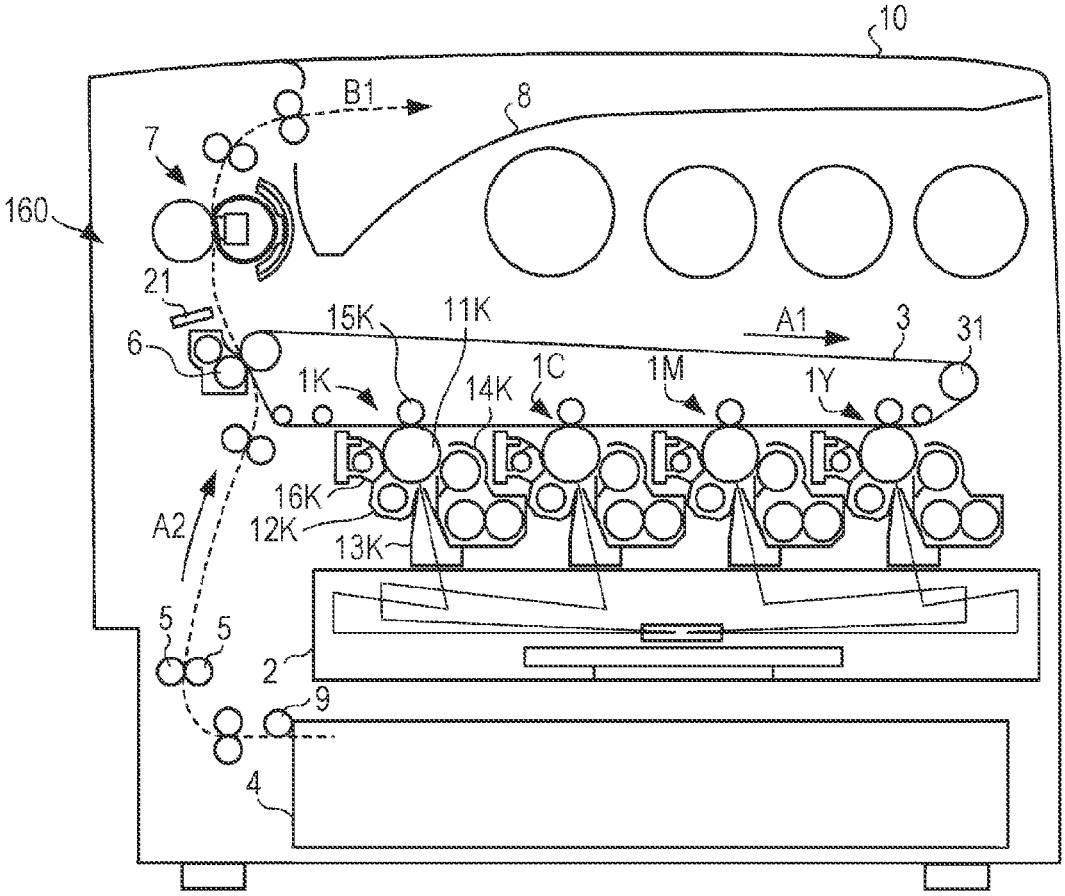
FIG. 2 illustrates the structure of the image forming section.

FIG. 2 illustrates the structure of the image forming section 160. In FIG. 2, components of the image forming section 160 are each denoted by a number accompanied by an alphabet that corresponds to a color used by the image forming apparatus. When two components are denoted by the same number and different alphabets, these components have the same structure but use toners in different colors. In the following description, where the color is not relevant, the alphabet after the numeral will be omitted. The image forming section 160 includes image forming units 1Y, 1M, 1C, and 1K; an exposure device 2; an intermediate transfer belt 3; a sheet feeder 4; plural transport rollers 5; a second-transfer roller 6; a fixing unit 7; an output unit 8; and a sheet sensor 21.

The exposure device 2 emits light (exposure light) toward the image forming units 1 in accordance with image data for different colors and forms electrostatic latent images to be developed into images in respective colors. The exposure device 2 is an exposure unit according to the present invention. The image forming units 1Y, 1M, 1C, and 1K develop the electrostatic latent images with toners and form images in respective colors. Hereinafter, the structure of each of the image forming units 1 will be described by using the image forming unit 1K as an example. The image forming unit 1K includes a photoconductor 11K, a charger 12K, an exposure unit 13K, a developing device 14K, a first-transfer roller 15K, and a cleaning device 16K. The photoconductor 11K is a cylindrical member including a photoconductive film on a surface thereof. The photoconductor 11K rotates around an axis and carries an electrostatic latent image formed on the surface thereof. The photoconductor 11K is an example of an image carrier according to the present invention.

The charger 12K charges the photoconductor 11K to a predetermined potential. The charger 12K is an example of a charging unit according to the present invention. The exposure unit 13K forms a path along which exposure light emitted from the exposure device 2 reaches the photoconductor 11K. The exposure light emitted from the exposure device 2 passes through the exposure unit 13K and reaches the surface of the photoconductor 11K charged by the charger 12K, so that an electrostatic latent image is formed in accordance with image data. The developing device 14K contains a developer including a toner that is a non-magnetic substance and a carrier that is a magnetic substance. The developing device 14K supplies the toner of the developer to the electrostatic latent image and develops the electrostatic latent image, thereby forming an image on the surface of the photoconductor 11K. The developing device 14K is an example of a developing unit according to the present invention. The first-transfer roller 15K first-transfers the image from the photoconductor 11K to the intermediate transfer belt 3. The cleaning device 16K removes toner that remains on the surface of the photoconductor 11K after the image has been first-transferred.

The intermediate transfer belt 3 is looped over plural rollers including a driving roller 31 and is supported by these rollers. The driving roller 31 is driven by a driving mechanism (not shown) controlled by the controller 110 and rotates at a rotation speed determined by the controller 110. The intermediate transfer belt 3 is rotated by the driving roller 31 in a rotation direction A1 indicated by an arrow. The images formed by the image forming units are first-transferred to the outer peripheral surface of the intermediate transfer belt 3 so as to overlap one another. The sheet feeder 4 contains plural sheets.

The plural transport rollers 5 form a transport path B1 indicated by a broken-line arrow, which extends from the sheet feeder 4 to the output unit 8 via the second-transfer roller 6 and the fixing unit 7. The plural transport rollers 5 are transport units that transport a sheet along the transport path B1 in a transport direction A2 indicated by an arrow. The transport rollers 5 are driven by a driving mechanism (not shown) controlled by the controller 110 and rotate at a rotation speed determined by the controller 110. The second-transfer roller 6 contacts the intermediate transfer belt 3 and forms a transfer region for transferring an image. The second-transfer roller 6 second-transfers the images, which have been first-transferred to the intermediate transfer belt 3, to a sheet, which has been transported to the transfer region by the plural transport rollers 5. When these images have been second-transferred to the sheet, an image is formed on the sheet. The first-transfer roller 15K, the intermediate transfer belt 3, and the second-transfer roller 6 are examples of a transfer unit according to the present invention. The second-transfer roller 6 is driven by a driving mechanism (not shown) controlled by the controller 110 and rotates at a rotation speed determined by the controller 110. After the sheet has passed through the transfer region, the sheet is transported along the transport path B1 to the fixing unit 7.

A feed roller 9 is driven at a timing determined by the controller 110, and feeds the sheets contained in the sheet feeder 4 one by one to the transport path B1. By controlling the timing of rotating the feed roller 9, the distance between the sheets transported along the transport path B1 is adjusted. The distance between the sheets is adjusted in accordance with, for example, whether or not post-processing (such as sorting, stapling, punching, and binding) is performed by a finisher (post-processing device, not shown), the sheet size, the print mode (monochrome or color), and an image quality. The transport speed of the sheets may be adjusted in addition to or instead of the adjustment of the distance between the sheets. However, in general, only the distance between the sheets is adjusted because, as described below, movements of a large number of components need to be adjusted to change the transport speed.

The fixing unit 7 applies heat and pressure to the image that has been second-transferred to the transport sheet, and thereby fixes the image onto the sheet. The timing at which the fixing unit 7 applies heat and the like are controlled by the controller 110 illustrated in FIG. 1. The fixing unit 7 and the controller 110 cooperate to function as a "fixing device" according to the present invention. The sheet onto which the image has been fixed is transported by the plural transport rollers 5 and is output to the output unit 8.

The transport speed of the sheet is determined by the rotation speeds of the plural transport rollers 5, the intermediate transfer belt 3, and the second-transfer roller 6. These rotation speeds are determined by the controller 110 as described above. That is, the controller 110 determines these rotation speeds and thereby controls the transport speed of the sheet within the range of, for example, 150 to 200 mm/s. To be specific, the controller 110 supplies control signals to the aforementioned driving mechanisms in accordance with the transport speed and thereby controls the driving mechanisms so that the sheet is transported at the transport speed.

The sheet sensor 21 detects whether or not a sheet is present (presence of the sheet) at a certain position along the transport path B1. Hereinafter, the position at which the sheet sensor 21 detects the presence of a sheet will be referred to as a "sheet detection position". The sheet sensor 21 is disposed such that the sheet detection position is located between the transfer region and the fixing unit 7 along the transport path B1. The sheet sensor 21 is, for example, an optical sensor that emits light toward the sheet detection position and receives light reflected from the sheet detection position. The intensity of light received by the sheet sensor 21 differs between a time when a sheet is present at the sheet detection position and a time when a sheet is not present at the sheet detection position. For example, if the intensity of light is equal to or higher than a threshold, a sheet is present at the sheet detection position, and if not, a sheet is not present at the sheet detection position. The sheet sensor 21 supplies detection data, which indicates the result of detection, to the controller 110. The detection data is, for example, data of the intensity of received light. The controller 110 determines that a sheet is present at the sheet detection position if the intensity represented by the detection data is equal to or higher than the threshold and determines that a sheet is not present at the sheet detection position if the intensity is lower than the threshold.

Fixing Unit

Figure 3A:
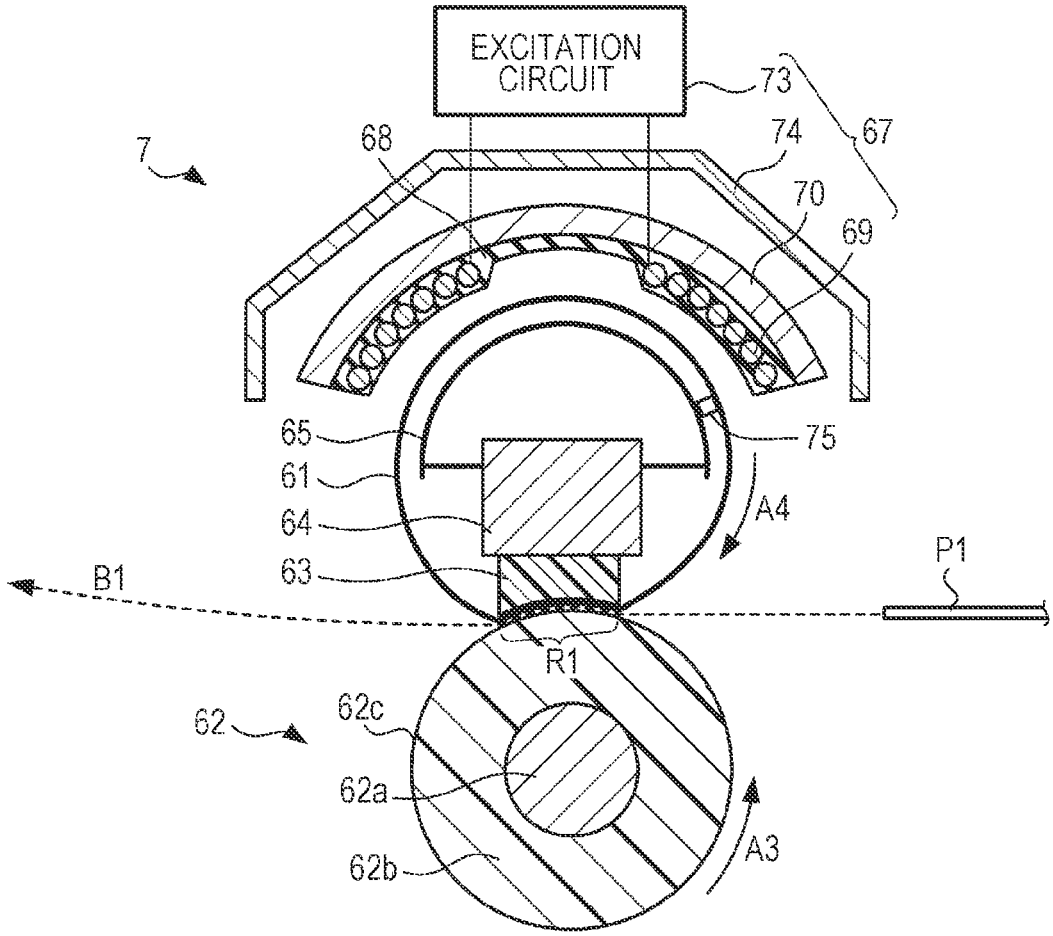
FIGS. 3A and 3B illustrate the structure of a fixing unit.

As illustrated in FIG. 3A, in the present exemplary embodiment, the fixing unit 7 includes a fixing belt 61 having an annular cross-sectional shape, a pressure roller 62, a pressure pad 63, and an induction heater 67. The pressure roller 62 is disposed so as to be pressed against the outer peripheral surface of the fixing belt 61 and forms a nip R1 between the pressure roller 62 and the fixing belt 61. The pressure pad 63 is disposed on the back side of the fixing belt 61 to press the fixing belt 61 between the pressure pad 63 and the pressure roller 62 at the nip R1. The induction heater 67 inductively heats the fixing belt 61. A peel-off member, which peels off a sheet wound around the fixing belt 61, may be disposed near a part of the fixing belt 61 on the exit side of the nip R1. Hereinafter, components of the fixing unit 7 will be described.

Fixing Belt

Figure 3B:
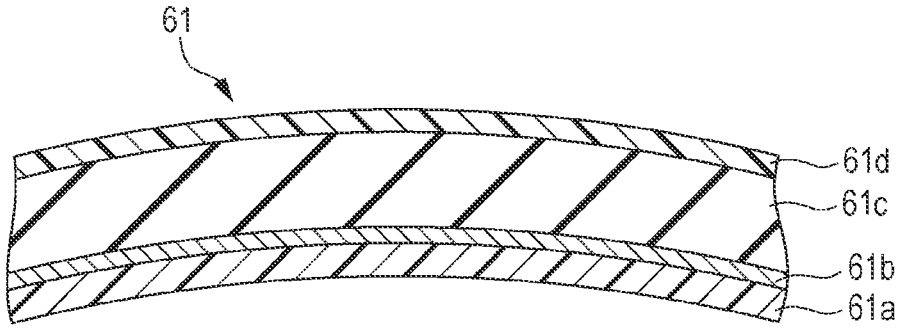

As illustrated in FIG. 3B, the fixing belt 61 includes, in sequence from the inner peripheral side, a base layer 61*a* made from a sheet-like member having high heat resistance, a conductive layer 61*b* disposed on the base layer 61*a*, an elastic layer 61*c* disposed on the conductive layer 61*b*, and a surface releasing layer 61*d* disposed on the elastic layer 61*c*. The fixing belt 61 is an example of a fixing member according to the present invention.

The base layer 61*a* may be made from a material having flexibility, high mechanical strength, and high heat resistance, such as a fluorocarbon resin, a polyimide resin, a polyamide resin, a polyamide-imide resin, a PEEK resin, a PES resin, a PPS resin, a PFA resin, a PTFE resin, or a FEP resin. The thickness of the base layer 61*a* may be in the range of 10 to 150 μm. If the thickness is smaller than 10 μm, the strength of the fixing belt 61 is insufficient. If the thickness is larger than 150 μm, the flexibility is low, and the heat capacity is large, so that it takes a longer time to increase the temperature.

The conductive layer 61*b* is a layer (heat generating layer) that is inductively heated by a magnetic field generated by the induction heater 67. The conductive layer 61*b* is made of a metal such as iron, cobalt, nickel, copper, aluminum, or chrome and has a thickness in the range of about 1 to 80 μm. The material and the thickness of the conductive layer 61*b* is appropriately selected so that the conductive layer 61*b* has a specific resistance value with which a sufficient amount of heat is generated by eddy current caused by electromagnetic induction.

The elastic layer 61*c* has a thickness in the range of 10 to 500 μm and is made of a material having high heat resistance and high heat conductivity, such as a silicone rubber, a fluorocarbon resin rubber, or a fluorosilicone rubber.

When printing a color image and in particular when printing a photographic image or the like, a solid image is usually formed over a large area on a sheet. Therefore, if the surface (surface releasing layer 61*d*) of the fixing belt 61 is unable to follow the asperities on the surface of a sheet or a toner image, the toner image is heated unevenly and therefore a fixed image may have an uneven gloss due to unevenness in the amount of transferred heat. That is, a portion of the fixed image to which a large amount of heat was transferred has a high gloss and a portion of the fixed image to which a small amount of heat was transferred has a low gloss. Such a phenomenon is more likely to occur if the thickness of the elastic layer 61*c* is smaller than 10 μm. Therefore, the thickness of the elastic layer 61*c* may be equal to or larger than 10 μm. On the other hand, if the thickness of the elastic layer 61*c* is larger than 500 μm, the thermal resistance of the elastic layer 61*c* is high and therefore the quick-start ability of the fixing unit 7 is low. Therefore, the thickness of the elastic layer 61*c* may be equal to or smaller than 500 μm.

If the hardness of the elastic layer 61*c* is too high, the elastic layer 61*c* is unable to follow the asperities on the surface of a sheet and a toner image, so that a fixed image is likely to have an uneven gloss. Therefore, a hardness equal to or lower than 50° (JIS-A:JIS-K A-type testing machine) is appropriate for the elastic layer 61*c*.

Regarding the thermal conductivity λ of the elastic layer 61*c*, the range of $6\times10^{-4}$ to $2\times10^{-3}$ [cal/cm·sec·deg] is appropriate. If the thermal conductivity λ is smaller than $6\times10^{-4}$ [cal/cm·sec·deg], the thermal resistance is high and the rate of increase in the temperature of the surface layer (surface releasing layer 61*d*) of the fixing belt 61 is low. On the other hand, if the thermal conductivity λ is higher than $2\times10^{-3}$ [cal/cm·sec·deg], the hardness may become excessively high or the compression set may become worse.

Because the surface releasing layer 61*d* directly contacts an unfixed toner image transferred to a sheet, the material of the surface releasing layer need to have high releasability and high heat resistance. Therefore, the material of the surface releasing layer 61*d* may be, for example, tetrafluoroethylene-perfluoroalkoxyethylene copolymer (PFA), polytetrafluoroethylene (PTFE), a fluorocarbon resin, a silicone resin, a fluorosilicone rubber, a fluorocarbon resin rubber, or a silicone rubber.

The thickness of the surface releasing layer 61*d* may be in the range of 5 to 50 μm. If the thickness of the surface releasing layer 61*d* is smaller than 5 μm, uneven application may occur when forming the layer and thereby a region having low releasability may be formed or the durability may be insufficient. If the thickness of the surface releasing layer 61*d* is larger than 50 μm, the heat conductivity may be low, and in particular when the surface releasing layer 61*d* is made of a resin material, the hardness may be too high and thereby the function of the elastic layer 61*c* may be low. To improve the toner releasability of the surface releasing layer 61*d*, an oil application mechanism that applies an oil (releasing agent) to prevent toner offset to the surface releasing layer 61*d* may be disposed in contact with the fixing belt 61.

Pressure Roller

The pressure roller 62 includes a cylindrical roller member 62*a*, an elastic layer 62*b* disposed on the surface of the cylindrical roller member 62*a*, and a surface releasing layer 62*c* on the outermost surface of the pressure roller 62. The cylindrical roller member 62*a* is a metal core. The elastic layer 62*b* is made of a material having high heat resistance such as a silicone rubber, a silicone rubber foam, a fluorocarbon resin rubber, or a fluorocarbon resin. The pressure roller 62 is an example of a pressure member according to the present invention.

As described below, the pressure roller 62 contacts the fixing belt 61 or becomes separated from the fixing belt 61. FIG. 3A illustrates the pressure roller 62 in contact with the fixing belt 61. When the pressure roller 62 is in contact with the fixing belt 61, the pressure roller 62 is pressed against the fixing belt 61 by an urging unit (not shown) such as a spring with a predetermined load (nip load) and forms a nip between the pressure roller 62 and the fixing belt 61. A sheet (denoted by P1 in FIG. 3A) is transported to the nip R1 along a transport path B1 by the plural transport rollers 5 illustrated in FIG. 2. The transport rollers 5 transport the sheet P, on which an image has been formed, to the nip R1. The transport rollers 5 are examples of a "transport unit" according to the present invention. The pressure roller 62 rotates in a rotation direction A3 indicated by an arrow in FIG. 3A, and the fixing belt 61 rotates in a rotation direction A4 indicated by an arrow. As the pressure roller 62 and the fixing belt 61 rotate in these directions, the sheet P1, which has been transported to the nip R1, passes through the nip R1 and is transported along the transport path B1 again.

Pressure Pad

The pressure pad 63 is made of an elastic material such as a silicone rubber or a fluorocarbon resin rubber, or a heat resistant resin such as a polyimide resin, polyphenylene sulfide (PPS), polyether sulfone (PES), or a liquid crystal polymer (LCP). The pressure pad 63 has a length in the width direction of the fixing belt 61 that is slightly larger than the width of a region on the fixing belt 61 over which a sheet passes. The pressure pad 63 presses the pressure roller 62 over substantially the entire length of the pressure pad 63.

A sliding sheet (not shown) is disposed between the pressure pad 63 and the fixing belt 61 in order to reduce friction between the pressure pad 63 and the fixing belt 61 at the nip R1, in which the fixing belt 61 is nipped between the pressure pad 63 and the pressure roller 62. The sliding sheet is made of a material having low-friction and high abrasion-resistant property such as a polyimide resin film or a glass fiber sheet impregnated with a fluorocarbon resin. A lubricant is applied to the inner peripheral surface of the fixing belt 61. As the lubricant, an amino-modified silicone oil, a dimethyl silicone oil, or the like is used. Thus, friction between the fixing belt 61 and the pressure pad 63 is reduced and the fixing belt 61 is rotated smoothly.

Support Member

A support member 64, which supports the pressure pad 63, is disposed inside of the fixing belt 61. The support member 64 has a bar-like shape extending in the longitudinal direction of the pressure pad 63. The pressure pad 63 is disposed on the lower side of the support member 64. The support member 64 is made of a material having a predetermined rigidity with which the support member 64 is bent by only a small amount (that is, for example, 1 mm or less) when the support member 64 receives a pressing force from the pressure roller 62. Examples of the material include metals such as iron, a stainless steel, and aluminum.

In the present exemplary embodiment, a temperature-sensitive magnetic metal 65 such as an Fe—Ni alloy is fixed to the support member 64 inside the fixing belt 61. The temperature-sensitive magnetic metal 65 is disposed on a side of the support member 64 opposite to the side on which the pressure pad 63 is disposed. The temperature-sensitive magnetic metal 65 faces the inner peripheral surface of the fixing belt 61 with a predetermined gap therebetween. The temperature-sensitive magnetic metal 65 has slits (not shown) formed in appropriate portions thereof, so that it is not inductively heated by the induction heater 67. Instead, the temperature-sensitive magnetic metal 65 is radiantly heated by the fixing belt 61. As a result, the temperature of the temperature-sensitive magnetic metal 65 changes so as to follow the temperature of the fixing belt 61. When the temperature of the temperature-sensitive magnetic metal 65 rises to a Curie point, the magnetic permeability of the temperature-sensitive magnetic metal 65 decreases and the magnetic property of the temperature-sensitive magnetic metal 65 changes from ferromagnetic to non-magnetic. Therefore, when the temperature of the temperature-sensitive magnetic metal 65 reaches a Curie point, heating of the fixing belt 61 by the induction heater 67 is restrained and overheating of the fixing belt 61 is prevented.

Induction Heater

The induction heater 67 is disposed outside of the fixing belt 61 so as to face the temperature-sensitive magnetic metal 65. The induction heater 67 is an example of an induction heating unit according to the present invention. In the present exemplary embodiment, the induction heater 67 includes a base 68, an excitation coil 69 supported by the base 68, and an excitation circuit 73. The base 68 has a curved surface having a shape that follows the shape of the fixing belt 61. The excitation circuit 73 supplies high-frequency current to the excitation coil 69. The base 68 is made of a material having insulation property and heat resistance such as a phenolic resin, a polyimide resin, a polyamide resin, a polyamide-imide resin, or a liquid crystal polymer. The excitation coil 69 has a surface having a substantially arc-shaped cross section so that the excitation coil 69 faces the fixing belt 61, which has a substantially cylindrical shape, with a uniform distance therebetween.

In the present exemplary embodiment, a magnetic flux holding member 70 is disposed on the back side of the base 68. The magnetic flux holding member 70, which is made of a material having high magnetic permeability (such as ferrite or permalloy), holds magnetic flux generated by the excitation coil 69. A shield 74 is disposed outside of the magnetic flux holding member 70. The shield 74 shields and prevents leakage of the magnetic field to the outside.

In the induction heater 67 having the structure described above, when the excitation circuit 73 supplies high-frequency current to the excitation coil 69, magnetic flux is alternately generated and annihilated around the excitation coil 69. The frequency of the high-frequency current is in the range of, for example, 10 to 500 kHz. When the generated magnetic flux passes through the conductive layer 61*b* of the fixing belt 61, an eddy current is generated in the conductive layer 61*b* so as to generate a magnetic field that resists change in the magnetic field, and thereby Joule heat is generated with electric power that is proportional to the skin resistance of the conductive layer 61*b*. A region of the fixing belt 61 that is heated when high-frequency current flows through the excitation coil 69 and an induction current flows in the conductive layer 61*b* may be referred to as a heat region. The heat region is determined in accordance with the shape of the excitation coil 69.

A temperature sensor 75 is disposed in a gap between the temperature-sensitive magnetic metal 65 and the fixing belt 61. As illustrated in FIG. 3A, in the present exemplary embodiment, the temperature sensor 75 is disposed at the downstream end of the heat region in the rotation direction A4, i.e., a position at which heating of the fixing belt 61 finishes, so as to contact the inner periphery of the fixing belt 61. Thus, the temperature sensor 75 measures the temperature of a part of the fixing belt 61 for which heating by the induction heater 67 has substantially finished. The temperature sensor 75 supplies data of the measured temperature to the controller 110 illustrated in FIG. 1. As described below, the controller 110 controls the high-frequency current that flows through the excitation coil 69 on the basis of the temperature of the fixing belt 61 measured by the temperature sensor 75 and a target temperature that has been set. Plural (for example, two) temperature sensors 75 may be disposed at different positions in the axial direction of the fixing belt 61.

Drive Transmission Mechanism of Fixing Unit

Figure 4:
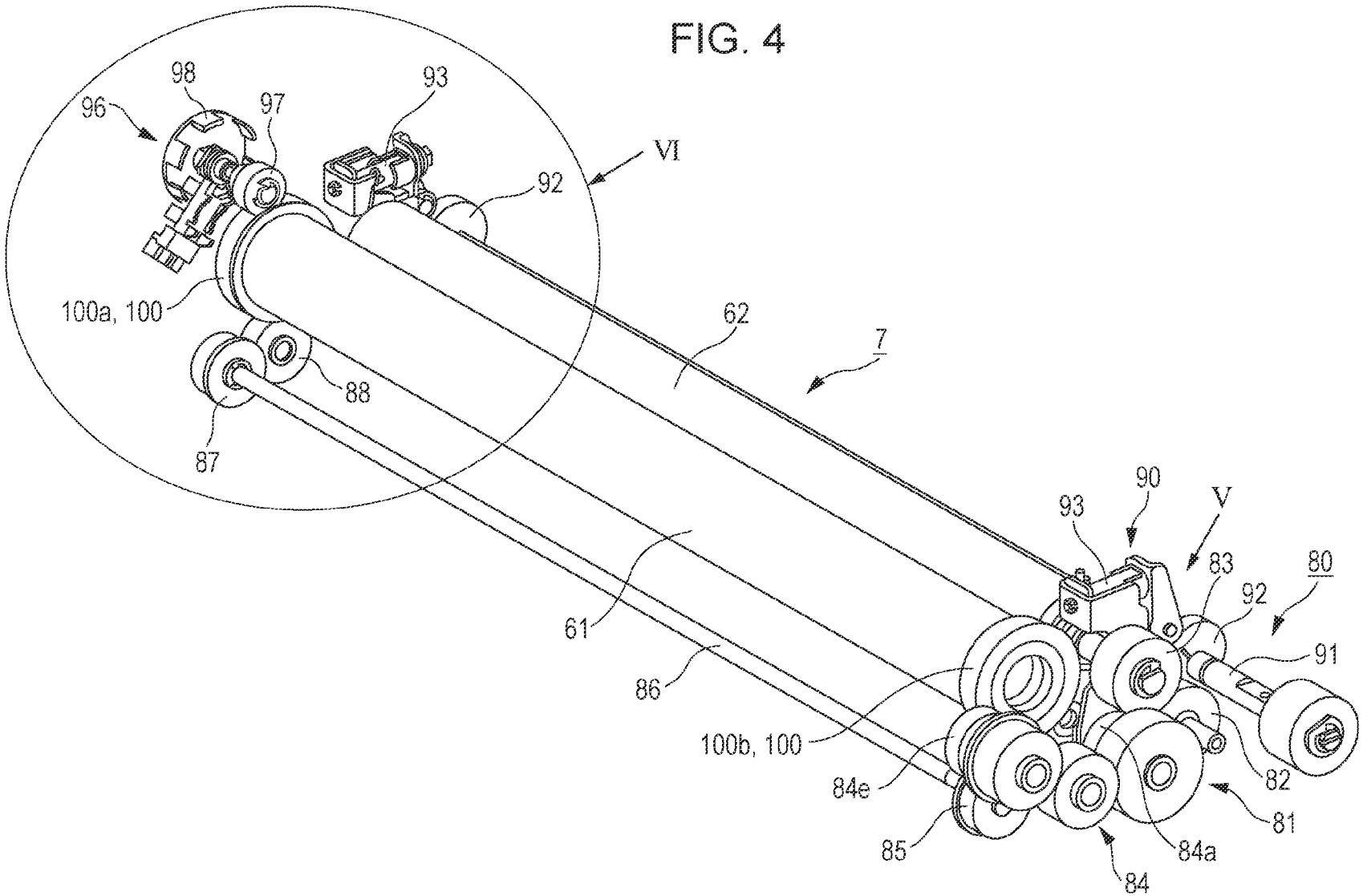
FIG. 4 is a perspective view illustrating the details of the fixing unit.
Figure 5:
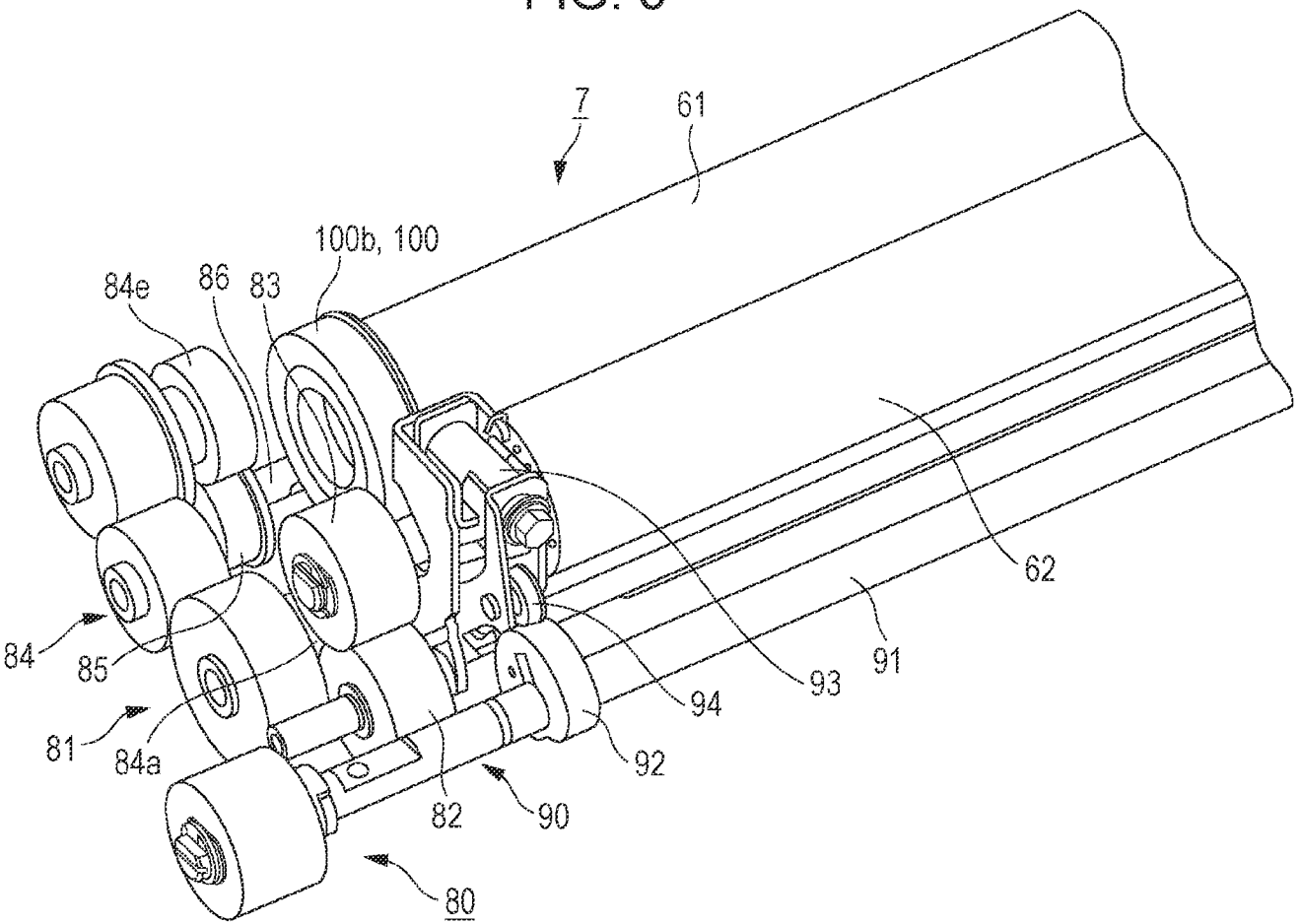
FIG. 5 is an enlarged partial perspective view of the fixing unit seen in the direction of arrow V in FIG. 4.
Figure 6:
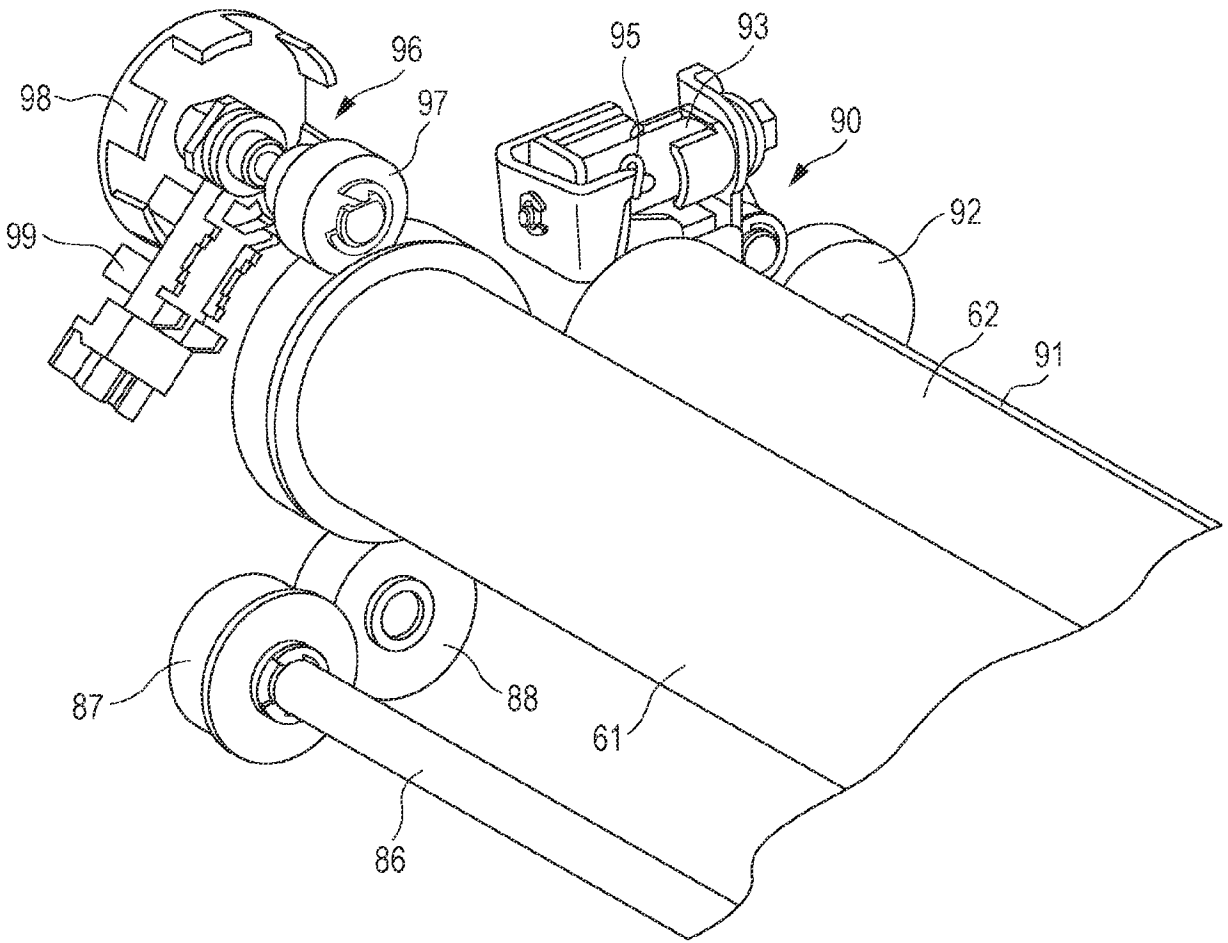
FIG. 6 is an enlarged partial perspective view illustrating a portion of the fixing unit surrounded by line VI in FIG. 4.

Referring to FIGS. 4 to 6, the overall structure of a drive transmission mechanism 80 of the fixing unit 7 will be described. FIG. 4 is a perspective view illustrating the details of the fixing unit 7; FIG. 5 is an enlarged partial perspective view of the fixing unit seen in the direction of arrow V in FIG. 4; and FIG. 6 is an enlarged partial perspective view illustrating a portion of the fixing unit surrounded by line VI in FIG. 4. As illustrated in FIGS. 4 to 6, the drive transmission mechanism 80 includes a rotation transmission mechanism 81 and a movement mechanism 90. The rotation transmission mechanism 81 rotates the fixing belt 61 and the pressure roller 62. The movement mechanism 90 moves the pressure roller 62 relative to the fixing belt 61 so that the pressure roller 62 may be in contact with the fixing belt 61 or may be separated from the fixing belt 61.

The rotation transmission mechanism 81 includes a driving gear 82 that is connected to a driving motor 81M (not shown in FIGS. 4 to 6), which is disposed on one side of the fixing unit 7 in the longitudinal direction. The driving gear 82 meshes with a drive transmission gear 83, which transmits a driving force to the pressure roller 62 to drive the pressure roller 62.

The rotation transmission mechanism 81 further includes a drive transmission gear train 84 including plural drive transmission gears. The driving gear 82 meshes with a first drive transmission gear 84*a* of the drive transmission gear train 84. A clutch gear 85 meshes with a last drive transmission gear

84*e* of the drive transmission gear train 84. A drive transmission gear 87 for transmitting a driving force to the fixing belt 61 is disposed on a side opposite to the clutch gear 85 in the longitudinal direction of the fixing belt 61. The drive transmission gear 87 is connected to the clutch gear 85 through a connection rod 86. The drive transmission gear 87 meshes with an end cap 100, which is a last drive transmission member, through a drive transmission gear 88. Thus, a rotational driving force of the driving motor 81M is transmitted to the fixing belt 61 and the fixing belt 61 is rotated. The end cap 100 (to be specific, 100*a* and 100*b*) are end covers that are inserted onto the two end portions of the fixing belt 61. The end cap 100 is rotatably fitted onto a shaft portion (not shown) formed on two end portions of the support member 64 disposed inside of the fixing belt 61.

The movement mechanism 90 includes a rotary rod 91 that is rotatable and extends in the axial direction of the pressure roller 62. An eccentric cam 92 is fixed to each of the ends of the rotary rod 91 in the axial direction. A swing lever 93, which is swingable, is disposed so as to correspond to the eccentric cam 92. The swing lever 93 includes a cam follower 94, which has a roller-like shape and contacts a cam surface of the eccentric cam 92. The cam follower 94 is constantly pressed against the cam surface of the eccentric cam 92 by an urging force of an elastic spring 95. When the rotary rod 91 is rotated by a latch motor 90M (not shown in FIGS. 4 to 6), the cam surface of the eccentric cam 92 moves and the position of the swing lever 93 is changed via the cam follower 94. The shaft (cylindrical roller member 62*a*) of the pressure roller 62 is rotatably supported by the swing lever 93. Therefore, the position of the pressure roller 62 relative to the fixing belt 61 changes in accordance with the position of the swing lever 93, and thereby the pressure roller 62 contacts or becomes separated from the fixing belt 61. The movement mechanism 90 is an example of a movement unit according to the present invention. The pressure roller 62 is constantly pressed against the fixing belt 61 by an urging unit (not shown). Therefore, the operation of separating the pressure roller 62 away from the fixing belt 61 is performed against the urging force of the urge unit.

A rotation detector 96, which is illustrated in FIGS. 4 and 6, detects the rotation speed of the fixing belt 61. In the present exemplary embodiment, the rotation detector includes a detection gear 97, a rotation detection plate 98, and an optical sensor 99. The detection gear 97 rotates in accordance with rotation of the end cap 100, the rotation detection plate 98 rotates coaxially with the detection gear 97, and the optical sensor 99 detects rotation of the rotation detection plate 98. That is, the rotation detector 96 functions as a so-called rotary encoder. The rotation detector 96 is an example of a speed sensor according to the present invention.

Operation of Fixing Unit

To operate the fixing unit 7 to fix images on plural sheets that are successively supplied to the fixing unit 7, the controller 110 drives the driving motor 81M, so that a driving force is transmitted from the driving motor 81M to the rotation transmission mechanism 81, and the fixing belt 61 and the pressure roller 62 are rotated by the driving force. When the fixing belt 61 starts rotating and the optical sensor 99 detects rotation of the end cap 100 as rotation of the rotation detection plate 98 of the rotation detector 96, the controller 110 causes the excitation circuit 73 to supply high-frequency current to the excitation coil 69. Thus, the fixing belt 61 is heated. When it is detected that the temperature of the fixing belt 61 has increased to a predetermined temperature from the output of the temperature sensor 75, the controller 110 determines that warming up of the fixing belt 61 has finished, and disengages the clutch gear 85 of the rotation transmission mechanism 81. As a result, transmission of the driving force from the driving motor 81M to the fixing belt 61 through the rotation transmission mechanism 81 is stopped, and the fixing belt 61 is rotated by the pressure roller 62 when the fixing belt 61 is in contact with the pressure roller 62 and continues rotating due to inertia when the fixing belt 61 is not in contact with the pressure roller 62. Therefore, after warming up has finished, the rotation speed of the fixing belt 61 is determined by the circumferential speed (the speed of the outer peripheral surface) of the pressure roller 62 and is controlled by controlling the rotation seed of the pressure roller 62.

After warming up of the fixing belt 61 has finished, while the pressure roller 62 is in contact the fixing belt 61 the nip R1 is formed therebetween, a sheet having an unfixed toner image thereon is passed through the nip R1 and thereby toner is fixed onto the sheet by heat and pressure.

Figure 7:
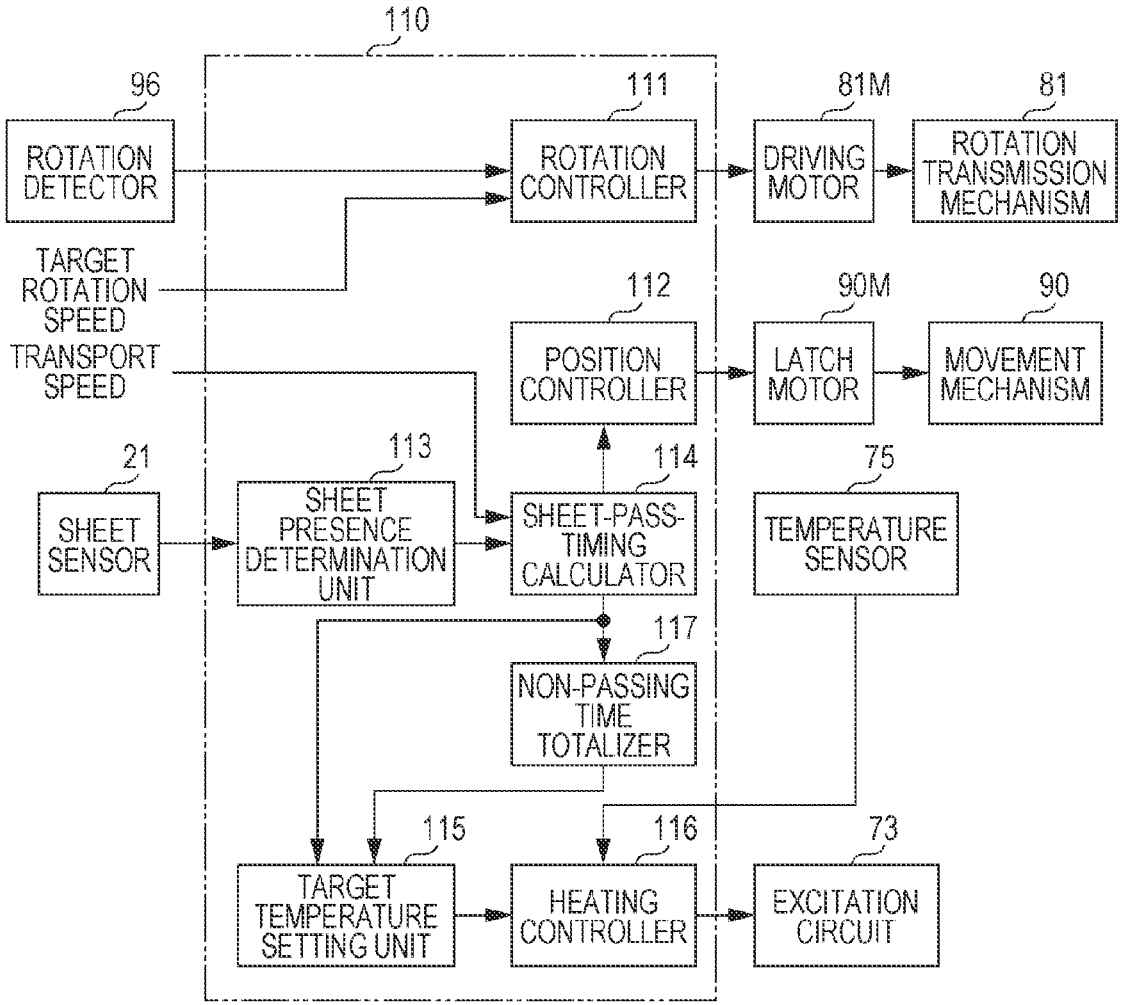
FIG. 7 is a block diagram illustrating functions performed by a controller to control the fixing unit.

FIG. 7 is a block diagram illustrating functions performed by the controller 110 to control the fixing unit 7. As illustrated in FIG. 7, the controller 110 includes a rotation controller 111, a position controller 112, a sheet presence determination unit 113, a sheet-pass-timing calculator 114, a target temperature setting unit 115, a heating controller 116, and a non-passing-time totalizer 117. The functions of these components of the controller 110 are realized when the CPU executes a program stored in the memory of the controller 110.

The rotation controller 111 controls the driving motor 81M, which supplies a rotational driving force to the rotation transmission mechanism 81. For example, when a DC motor is used as the driving motor 81M, the rotation controller 111 controls the rotation speed of the driving motor 81M by controlling the voltage or the current of electricity applied to the driving motor 81M. As described above, after warming up of the fixing belt 61 has finished, the rotational driving force of the driving motor 81M is transmitted to the pressure roller 62 through the rotation transmission mechanism 81, and the fixing belt 61 is rotated by the pressure roller 62. After warming up of the fixing belt 61 has finished, while fixing operations are performed on plural sheets, the rotation controller 111 controls the rotation speed of the pressure roller 62 by controlling the voltage or the current of electricity applied to the driving motor 81M so that the rotation speed of the fixing belt 61, which is obtained on the basis of a detection signal from the rotation detector 96, becomes a predetermined target rotation speed. The voltage or the current of electricity applied to the driving motor 81M is an example of a control variable for controlling a pressure member according to the present invention. The target rotation speed may be stored in the memory 150 beforehand, or in the case where the sheet transport speed is variable, the target rotation speed may be set by the controller 110 in accordance with the sheet transport speed.

The position controller 112 controls the latch motor 90M in accordance with sheet-pass timings, which are sent from the sheet-pass-timing calculator 114 described below, and drives the movement mechanism 90 to move the pressure roller 62 so as to contact the fixing belt 61 or be separated from the fixing belt 61. Here, the term "sheet-pass timings" refers to a timing at which a sheet reaches the nip R1 and a timing at which the sheet exits the nip R1. From the sheet-pass timings, a period during which a sheet is present in the nip R1 (i.e., a period during which a sheet passes through the nip R1) and a period during which a sheet is not present in the nip R1 (i.e., a period during which a sheet does not pass through the nip R1) are calculated.

The sheet presence determination unit 113 determines whether or not a sheet is present at the sheet detection position on the basis of detection data sent from the sheet sensor 21. To be specific, the sheet presence determination unit 113 determines that a sheet is present at the sheet detection position if the intensity of light indicated by the detection data is equal to or higher than a threshold and determines that a sheet is not present at the sheet detection position if the intensity of light is lower than the threshold. The sheet presence determination unit 113 repeatedly performs such determination at predetermined intervals (for example, at 1 msec intervals) and sends the determination result to the sheet-pass-timing calculator 114.

The sheet-pass-timing calculator 114 calculates the sheet-pass timings at the nip R1 on the basis of the determination result regarding the presence of a sheet at the sheet detection position sent from the sheet presence determination unit 113. To calculate the sheet-pass timings at the nip R1, the memory 150 stores a first distance and a second distance. The first distance is the distance from the sheet detection position, at which the sheet sensor 21 detects the presence of a sheet, to the nip R1 along the transport path B1. The second distance is the sum of the first distance and the length of the nip R1 along the transport path B1. To be specific, the sheet-pass-timing calculator 114 performs the processing as follows.

First, the sheet-pass-timing calculator 114 recognizes that the leading edge of a sheet in the transport direction A2 has reached the sheet detection position when the determination result sent from the sheet presence determination unit 113 changes from that indicating the absence of a sheet to that indicating the presence of a sheet. The sheet-pass-timing calculator 114 recognizes that the trailing edge of a sheet in the transport direction A2 has reached the sheet detection position when the determination result changes from that indicating the presence of a sheet to that indicating the absence of a sheet. When detecting the leading end or the trailing end of a sheet, the sheet-pass-timing calculator 114 obtains the times at which such detection occurred (respectively referred to as a "leading-end detection time" and a "trailing-end detection time").

Next, the sheet-pass-timing calculator 114 calculates the time at which the sheet will reach the nip R1 (referred to as a "reach time") by adding a time calculated by dividing the first distance by the transport speed that is currently set to the obtained leading-end detection time. The reach time is an example of a reach timing. The time added here is a time from when the leading end of the sheet, which is being transported at this speed, passed the sheet detection position to when the leading end will reach the nip R1. The sheet-pass-timing calculator 114 also calculates the time at which the sheet will exit the nip R1 (referred to as an "exit time") by adding a time calculated by dividing the second distance by the transport speed that is currently set to the obtained trailing-end detection time. The exit time is an example of an exit timing. The time added here is a time from when the trailing end of the sheet, which is being transported at this speed, passed the sheet detection position to when the trailing end will exit the nip R1. If the current time is between the reach time and the exit time calculated as described above, the sheet is passing through the nip R1 (i.e., the sheet is present in the nip R1), and if not, the sheet is not passing through the nip R1 (i.e., the sheet is not present in the nip R1). The sheet-pass-timing calculator 114 supplies the calculated reach time and exit time to the position controller 112, the target temperature setting unit 115, and the non-passing-time totalizer 117.

On the basis of the sheet-pass timings sent from the sheet-pass-timing calculator 114, the non-passing-time totalizer 117 totals the times during which a sheet is not passing through the nip R1 (hereinafter referred to as a "non-passing period") from when supply of sheets to the nip R1 was started (or from when warming up of the fixing belt 61 was finished). Then, the non-passing-time totalizer 117 supplies the obtained total of the non-passing periods (hereinafter referred to as a "non-passing total time") to the target temperature setting unit 115.

The target temperature setting unit 115 sets a target temperature of the fixing belt 61 in accordance with the sheet-pass timings and the non-passing total time sent from the sheet-pass-timing calculator 114. The heating controller 116 controls the excitation circuit 73 of the induction heater 67 on the basis of the temperature of the fixing belt 61 detected by the temperature sensor 75 and the target temperature set by the target temperature setting unit 115, and thereby adjusts high-frequency current that is passed through the excitation coil 69. To be specific, the heating controller 116 controls the amount of high-frequency current supplied to the excitation coil 69 and the like in accordance with the difference between the temperature of the fixing belt 61 detected by the temperature sensor 75 and the target temperature, and performs PID control of electric power supplied to the excitation coil 69 to heat the conductive layer 61*b* (heat generating layer) of the fixing belt 61. If the temperature of the fixing belt 61 detected by the temperature sensor 75 is higher than the target temperature, the heating controller 116 controls the excitation circuit 73 so as to stop supply of high-frequency current to the excitation coil 69 so that the conductive layer 61*b* of the fixing belt 61 is not inductively heated.

Figure 8:
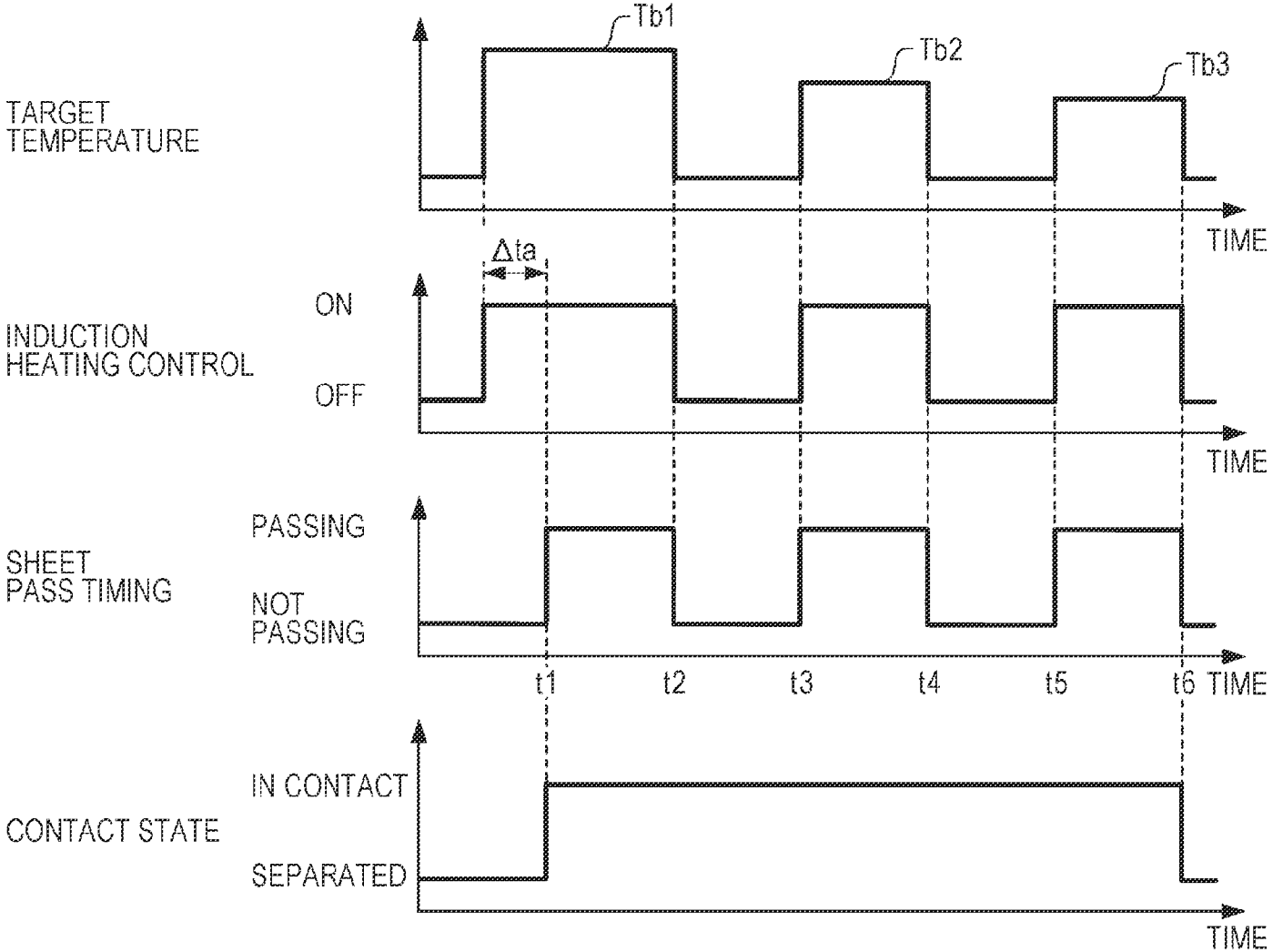
FIG. 8 is a timing chart of an operation when the fixing unit successively performs fixing operations on plural sheets.

FIG. 8 is a timing chart of an operation when the fixing unit 7 successively performs fixing operations on plural sheets (in this case, three sheets). In FIG. 8, the uppermost graph represents the target temperature set by the target temperature setting unit 115, the second graph from the top represents the status of induction heating control performed by the heating controller 116, the third graph from the top represent the timings (sheet pass timings) at which sheets pass through the nip R1, and the lowermost graph represents the state of contact between the pressure roller 62 and the fixing belt 61.

When fixing images on plural sheets, warming up of the fixing belt 61 is first performed. That is, as described above, the controller 110 drives the driving motor 81M to rotate the fixing belt 61 and the pressure roller 62, controls the excitation circuit 73 so as to pass high-frequency current through the excitation coil 69, and thereby inductively heats the conductive layer 61*b* of the fixing belt 61 (turns on induction heating). At this time, as illustrated in the graph of the target temperature in FIG. 8, the target temperature setting unit 115 sets the target temperature of the fixing belt 61 at a predetermined temperature Tb1 (for example, 160° C.). The heating controller 116 controls the excitation circuit 73 so as to control high-frequency current supplied to the excitation coil 69 on the basis of the difference between the temperature of the fixing belt 61 detected by the temperature sensor 75 and the target temperature Tb1, which has been set. When the temperature of the fixing belt 61 reaches the predetermined temperature and it is determined that warming up of the fixing belt 61 has finished, as described above, the controller 110 disengages the clutch of the clutch gear 85 of the rotation transmission mechanism 81, so that the fixing belt 61 is rotated by the pressure roller 62 when the fixing belt 61 is in contact with the pressure roller 62.

After warming up of the fixing belt 61 has finished, supply of sheets to the fixing unit 7 is started. As illustrated in the graph representing the sheet-pass timing, supply of the sheets to the fixing unit 7 (to be specific, to the nip R1) is started after a predetermined time Ata has passed from when induction heating was started. The time Ata is sufficiently long to warm up the fixing belt 61. In this example, times t1, t3, and t5 are the times at which sheets reach the nip R1; and times t2, t4, and t6 are the times at which the sheets exit the nip R1. That is, in this example, periods from t1 to t2, from t3 to t4, and from t5 to t6 are periods during which sheets are passing through the nip R1 (hereinafter referred to as "passing periods"), and periods before t1, from t2 to t3, from t4 to t5, and after t6 are periods during which sheets are not passing through the nip R1 (i.e., non-passing periods). As described above, the reach times t1, t3, and t5 and the exit times t2, t4, and t6 are calculated by the sheet-pass-timing calculator 114 and supplied to the position controller 112, the target temperature setting unit 115, and the non-passing-time totalizer 117.

As illustrated in the graph representing the state of contact between the pressure roller 62 and the fixing belt 61, the pressure roller 62 and the fixing belt 61 are made to contact each other at the timing at which the first sheet reaches the nip R1 (at the reach time t1). Subsequently, when the last sheet (in this example, the third sheet) exits the nip R1 (at the exit time t6), the pressure roller 62 and the fixing belt 61 are separated from each other. The position controller 112 controls the state of contact between the pressure roller 62 and the fixing belt 61 by, as described above, controlling the latch motor 90M for controlling the movement mechanism 90 and by controlling the position of the pressure roller 62 relative to the fixing belt 61.

The pressure roller 62 and the fixing belt 61 need not contact each other at the timing at which the first sheet reaches the nip R1. It is sufficient that the pressure roller 62 be in contact with the fixing belt 61 when the first sheet reaches the nip R1. For example, the pressure roller 62 may contact the fixing belt 61 before the first sheet reaches the nip R1 so that rotation of the fixing belt 61, which is in contact with and rotated by the pressure roller 62, is stabilized when the first sheet reaches the nip R1. The pressure roller 62 need not be separated from the fixing belt 61 at the timing at which the last sheet exits the nip R1. For example, the pressure roller 62 may be moved so that the pressure roller 62 is separated from the fixing belt 61 slightly before the time at which the last sheet exits the nip R1. This is because failure in fixing of an image does not occur if the pressure roller 62 is separated from the fixing belt 61 before the exit time, because an image is not usually formed in a trailing end portion of the sheet. The timing at which the pressure roller 62 contacts the fixing belt 61 and the timing at which the pressure roller 62 is separated from the fixing belt 61 may be adjusted as appropriate.

After supply of sheets to the nip R1 has been started, the target temperature setting unit 115 sets the target temperature of the fixing belt 61 for the passing period and for the non-passing period on the basis of the reach times t1, t3, and t5 and the exit times t2, t4, and t6 supplied from the sheet-pass-timing calculator 114. To be specific, the target temperature for the non-passing period is set at a temperature lower than a feasible temperature of the fixing belt 61 (for example, 0° C.). Thus, as illustrated in the graph representing the induction heating control, induction heating is turned off in a non-passing period (i.e., supply of high-frequency current to the excitation coil 69 is stopped). The feasible temperature of the fixing belt 61 for a non-passing period may be obtained by carrying out an experiment.

The target temperature setting unit 115 sets the target temperature of the fixing belt 61 for a passing period in accordance with the non-passing total time supplied from the non-passing-time totalizer 117. During a passing period, the heating controller 116 performs induction heating control on the basis of the set target temperature. To be specific, the longer the non-passing total time at the reach time of a sheet supplied to the nip R1, the lower the target temperature set by the target temperature setting unit 115.

In the example illustrated in FIG. 8, the non-passing total time at the reach time t1 at which the first sheet reaches the nip R1 is zero. Therefore, the target temperature for the passing period of the first sheet is set at Tb1, which is the same as the initial value (the target temperature during warming up). The non-passing total time at the reach time t2 at which the second sheet reaches the nip R1 is (t3−t2), which is the non-passing period between the first sheet and the second sheet. Therefore, the target temperature for the passing period of the second sheet is set at Tb2, which is lower than Tb1 for the passing period of the first sheet. The non-passing total time at the reach time t5 at which the third sheet reaches the nip R1 is the sum of (t3−t3), which is the non-passing period between the first sheet and the second sheet, and (t5−t4), which is the non-passing period between the second sheet and the third sheet. Therefore, the target temperature for the passing period of the third sheet is set at Tb3, which is lower than Tb2 for the passing period of the second sheet.

The target temperature setting unit 115 may set the target temperature for a passing period so that the target temperature converges to a constant value as the non-passing total time increases. This is because the temperature of the pressure roller 62, which is increased due to contact with the fixing belt 61, gradually converges to a constant value with time (that is, the pressure roller 62 becomes saturated with heat).

After fixing operations on plural sheets have finished, the non-passing total time is reset to zero. It may be determined that fixing operations on plural sheets have finished when, for example, the temperature of the fixing belt 61 has decreased to a level below a predetermined temperature (for example, a temperature at which warming up of the fixing belt 61 need to be started again).

Power consumption of the fixing unit 7 is reduced as compared to the case where the target temperature is not set in accordance with the non-passing total time by setting, as described above, the target temperature of the fixing belt 61 in accordance with the non-passing total time, which is measured from when plural sheets started passing the nip R1 after warming up of the fixing belt 61 had finished. Moreover, fixing failure is not likely to occur even if the target temperature of the fixing belt 61 is set in accordance with the non-passing total time. One reason for this is that the pressure roller, whose temperature has increased in accordance with the non-passing total time, contributes to heating of a sheet subjected to a fixing operation. Another reason is that, as the temperature of the pressure roller 62 has increased, the amount of heat transferred from the fixing belt 61 to the pressure roller 62 through a sheet is reduced, and thereby heat generated by the fixing belt 61 is efficiently used to increase the temperature of the sheet.

Modifications

The exemplary embodiment described above may be modified as follows. The exemplary embodiment described above and the modifications described below may be used in combination as necessary.

First Modification

In the exemplary embodiment described above, the target temperature setting unit 115 sets the target temperature of the fixing belt 61 for a non-passing period at a temperature at which induction heating is turned off (for example, 0° C.) However, the present invention is not limited thereto. The target temperature of the fixing belt 61 for a non-passing period may be any temperature lower than the target temperature for a passing period. Thus, power consumption of the fixing unit 7 during a non-passing period is reduced as compared with a case where the target temperature of the fixing belt 61 for a non-passing period is the same as that for a passing period.

Second Modification

In the exemplary embodiment described above, induction heating during the non-passing period is turned off by causing the target temperature setting unit 115 to set the target temperature of the fixing belt 61 for a non-passing period at a sufficiently low temperature (for example, 0° C.) However, induction heating during a non-passing period may be turned off by using another method. For example, the reach time and the exit time calculated by the sheet-pass-timing calculator 114 may be supplied to the heating controller 116, and the heating controller 116 may control the excitation circuit 73 so that high-frequency current supplied from the excitation circuit 73 to the excitation coil 69 becomes zero during a non-passing period that is specified from the reach time and the exit time.

Third Modification

In the exemplary embodiment described above, the non-passing total time is calculated on the basis of the reach time and the exit time of each sheet. However, the present invention is not limited thereto. For example, the target temperature of the fixing belt 61 may be set in accordance with the total value of the distances between the sheets, because the length of each non-passing period is determined by the distance between corresponding sheets if the sheet transport speed is constant.

Fourth Modification

The fixing unit 7 may include a thermal storage plate to increase the productivity. Here, the thermal storage plate is a member that is made of, for example, a temperature-sensitive magnetic alloy and that is disposed so as to be in contact with the inner peripheral surface of the fixing belt 61. The thermal storage plate is disposed in the heat region. The material and the thickness of the thermal storage plate are adjusted so that heat is generated due to electromagnetic induction using an alternate-current magnetic field generated by the induction heater 67. Heat generated by the thermal storage plate is supplied to the fixing belt 61. When the fixing unit 7 includes the thermal storage plate, the fixing belt 61 is heated not only with heat generated by the fixing belt 61 but also with heat generated by the thermal storage plate, so that decrease in the temperature of the fixing belt 61 while increasing the efficiency in electromagnetic induction heating by the induction heater 67 and the fixing unit 7 having high productivity is provided.

Fifth Modification

The controller 110 may include an application specific integrated circuit (ASIC). In this case, the functions of the controller 110 may be performed by the ASIC or by both the CPU and the ASIC.

Sixth Modification

A program that realizes the functions of the controller 110 may be provided in the form of a computer-readable storage medium and installed in the image forming apparatus 10. Examples of the computer-readable storage medium include magnetic recording medium (magnetic tape, magnetic disk (HDD, FD (Flexible Disk)), etc.), a light recording medium (optical disc (compact disc (CD), digital versatile disk (DVD)), or the like), a magneto-optical recording medium, and a semiconductor memory. The program may be downloaded and installed through a communication network.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member including a heat generating layer that generates heat by induction, the fixing member fixing images onto a plurality of recording media that are successively supplied thereto with heat generated from the heat generating layer;

a pressure member that contacts the fixing member and forms a nip between the pressure member and the fixing member, the nip allowing the recording media to pass therethrough;

an induction heating unit that inductively heats the heat generating layer of the fixing member; and a controller that controls a manner in which the induction heating unit heats the heat generating layer when the plurality of recording media successively pass through the nip in accordance with a total of times during which the recording media are not present in the nip, the total of times being measured from when the recording media started passing through the nip, wherein the controller controls heating based on a duration of time hich the recording media do not pass through the nip.

2. The fixing device according to claim 1, further comprising:

a temperature sensor that detects a temperature of the fixing member, wherein the controller sets a target temperature of the fixing member for a period during which the recording media pass through the nip in accordance with the total of times during which the recording media are not present in the nip, and the controller controls the induction heating unit so that a difference between the target temperature and the temperature of the fixing member detected by the temperature sensor decreases.

3. The fixing device according to claim 2, further comprising:

a movement unit that moves the pressure member relative to the fixing member so that the pressure member contacts the fixing member or becomes separated from the fixing member, wherein the controller controls the movement unit so that the pressure member becomes separated from the fixing member before the plurality of recording media start passing through the nip, and the controller controls the induction heating unit so that the heat generating layer of the fixing member is heated while the pressure member is separated from the fixing member.

4. The fixing device according to claim 1, further comprising:

a movement unit that moves the pressure member relative to the fixing member so that the pressure member contacts the fixing member or becomes separated from the fixing member, wherein the controller controls the movement unit so that the pressure member becomes separated from the fixing member before the plurality of recording media start passing through the nip, and the controller controls the induction heating unit so that the heat generating layer of the fixing member is heated while the pressure member is separated from the fixing member.

5. An image forming apparatus comprising:

an image carrier;

a charging unit that charges the image carrier;

an exposure unit that exposes the image carrier charged by the charging unit to light in accordance with image data and forms an electrostatic latent image;

a developing unit that develops the electrostatic latent image formed by the exposure unit and forms an image on a surface of the image carrier;

a transfer unit that transfers the image formed on the surface of the image carrier to a recording medium; and the fixing device according to claim 1, the fixing device fixing the image transferred to the recording medium onto the recording medium.

6. The fixing device according to claim 1, wherein the total of time is a total length of first non-passing time and second non-passing time.

7. The fixing device according to claim 1, wherein the induction heating unit is turned off in a non-passing period.

8. A fixing device comprising:

a fixing member including a heat generating layer that generates heat by induction, the fixing member fixing images onto a plurality of recording media that are successively supplied thereto with heat generated from the heat generating layer;

a pressure member that contacts the fixing member and forms a nip between the pressure member and the fixing member, the nip allowing the recording media to pass therethrough;

an induction heating unit that inductively heats the heat generating layer of the fixing member; and a controller that controls a manner in which the induction heating unit heats the heat generating layer when the plurality of recording media successively pass through the nip, wherein a first recording media of the plurality of recording media passes through the nip at a first passing time and a second recording media of the plurality of recording media passes through the nip at a second passing time, a non-passing time in which no recording media passes through the nip separates the first passing time and the second passing time, and wherein a temperature target setting device sets a target temperature for the first passing time and the second passing time inversely proportional to the total number of preceding non-passing times, such that the target temperature for the first passing time is higher than a target temperature for the second passing time, and wherein the controller controls the induction heating unit in accordance with the target temperature for each passing time.

* * * * *